United States Patent [19]

Lotte

[11] 3,952,650

[45] Apr. 27, 1976

[54] DOCTOR-BLADE HOLDER WITH CLEANING MEANS

[75] Inventor: Andre Lotte, Mulhause, France

[73] Assignee: Societe Alsacienne de Constructions Mecaniques de Mulhouse, Mulhouse Cedex, France

[22] Filed: Sept. 23, 1974

[21] Appl. No.: 508,340

[30] Foreign Application Priority Data

Sept. 21, 1973 France ..... 73.34033

[52] U.S. Cl. ..... 101/120; 101/157; 101/425

[51] Int. Cl.[2] ..... B41F 15/42; B41F 35/00; B41F 41/00

[58] Field of Search ..... 101/115, 116, 119, 120, 101/123, 124, 129, 366, 425, 157

[56] References Cited

UNITED STATES PATENTS

| | | | |
|---|---|---|---|
| 2,377,089 | 5/1945 | Lundbye | 101/157 |
| 2,792,780 | 5/1957 | Jacob | 101/119 |
| 2,928,340 | 3/1960 | Stein et al. | 101/120 |
| 3,658,003 | 4/1972 | Johnson | 101/366 X |
| 3,795,188 | 3/1974 | Giani | 101/119 |
| 3,878,780 | 4/1975 | Lotte | 101/119 |

*Primary Examiner*—Edgar S. Burr
*Assistant Examiner*—R. E. Suter
*Attorney, Agent, or Firm*—Haseltine, Lake & Waters

[57] ABSTRACT

In a doctor-blade system consisting of a strip of flexible material supported by a blade-holder fitted with resilient means for applying the free marginal portion of the doctor-blade against the screen during printing, at least one internal longitudinal passageway is formed within the blade-holder body and communicates at intervals with the internal blade face and with the resilient means, any trace of ink which may have infiltrated into the system being discharged to the exterior by means of an external supply of fluid under pressure.

6 Claims, 3 Drawing Figures

Figure 1:
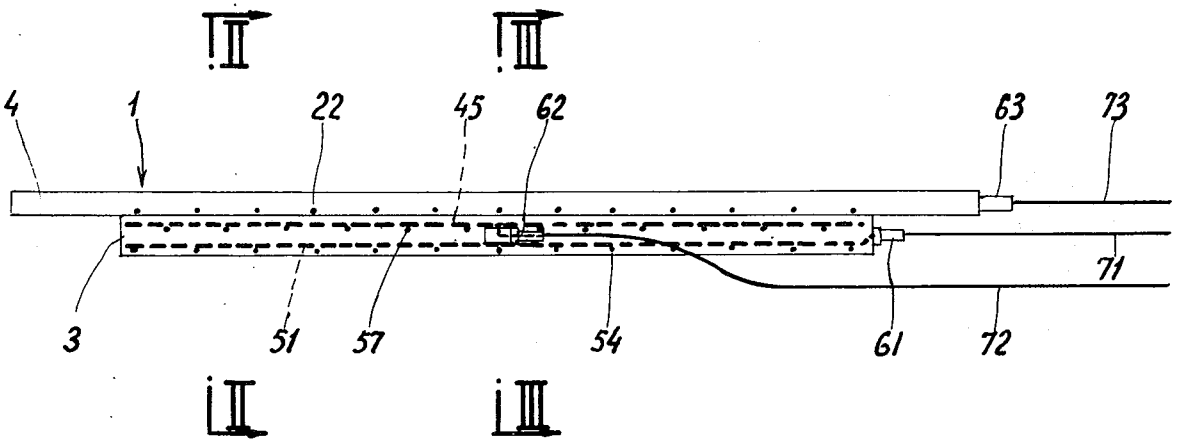

4
62
64
1
3
36
45
26
25
33
34
11
5
8
51
42
53
41
2
32
54
16
17
15
18
51
21
22
12
29
7
6

4
1
43
3
35
36
45
26
34
25
33
27
28
11
5
8
42
41
32
16
2
29
12
22
21
18
51
15
17
7
6

DOCTOR-BLADE HOLDER WITH CLEANING MEANS

This invention relates to a doctor-blade system for screen-printing machines, especially machines for printing materials in web form such as woven fabrics or papers by means or rotary screens, although other applications may be contemplated.

The invention is more especially directed to systems in which the doctor-blade consists of a strip of flexible material supported along its entire length by a blade-holder fitted with resilient means for applying pressure against the free marginal portion of the doctor-blade, the edge of which is intended to be applied against the screen during the printing operation.

In order to obtain a good impression, it is essential to operate with completely clean and dry wiping equipment. Failure to meet this requirement is liable to cause soiling of the fresh color with the preceding color, especially when a light color is used after a dark color, and also to result in local color distortions in the event of run-off of water which has previously been employed for washing the equipment prior to start-up of the machine and which could have accumulated at certain points of the doctor-blade system.

It had been the customary practice up to the present time to carry out the cleaning of doctor-blade systems by means of water sprayed either with a spray-gun or with a spray-tube. However, during the work of printing with the machine, upward movements of color take place within the doctor-blade system. As a consequence, when the system is washed with jets of water under pressure by means of a spray-gun, the water which penetrates from the exterior into the interior of the device has a tendency to accentuate this phenomenon of color penetration. Moreover, the water jet applied by the spray-gun does not always reach all the soiled zones in complex wiping systems. Furthermore, the systems in use at the present time usually call for the continuous presence of an operator during the entire washing operation and sometimes entails the need even for dismantling of the systems.

An object of this invention is to improve the aforesaid doctor-blade wiping systems in order to permit highly effective cleaning of said systems while reducing manual operations by personnel to a strict minimum.

To this end, provision is also made for means whereby the entire doctor-blade unit can be cleaned not from the exterior but from the interior by means of suitable jets of liquid for the purpose of expelling any trace of ink which could have infiltrated into the system from the exterior.

To this end, in accordance with the invention, the doctor-blade body has at least one internal longitudinal passageway connected at intervals to the internal face of the doctor-blade and to the aforementioned resilient pressure-application means.

It is thus possible to connect said passageway or passageways to a source of cleaning fluid under pressure and if necessary to a source of drying fluid, with the result that highly effective cleaning of the whole assembly is achieved from the interior towards the exterior while cleaning of the entire device is being carried out from the exterior and every remaining trace of ink which may have infiltrated into the system during a printing operation is completely removed.

Figure 3:
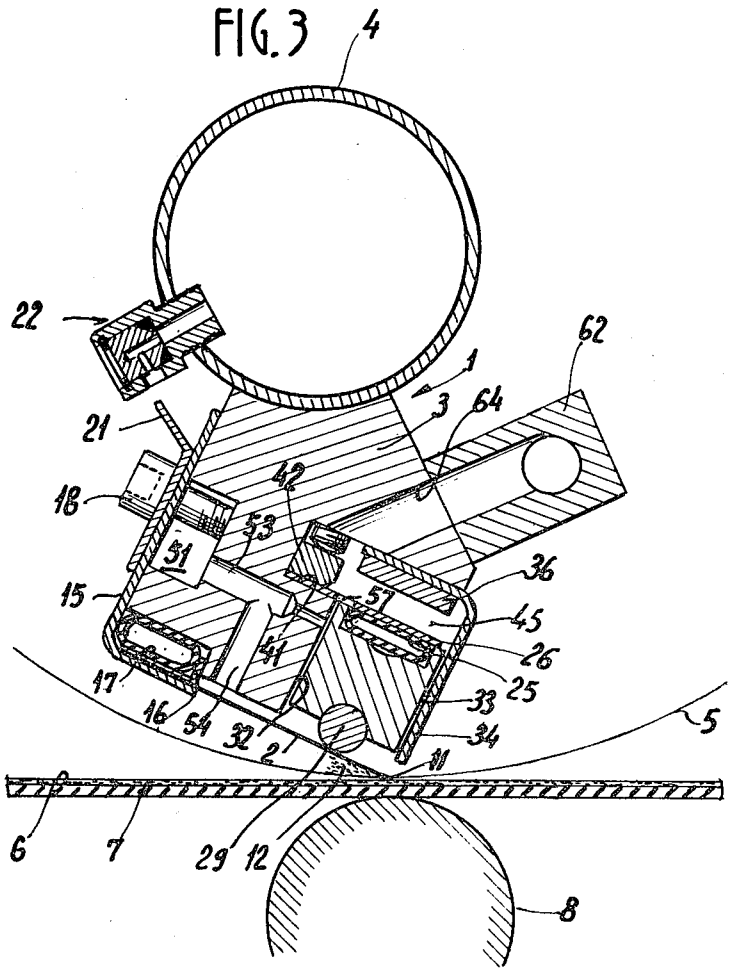
Figure 2:
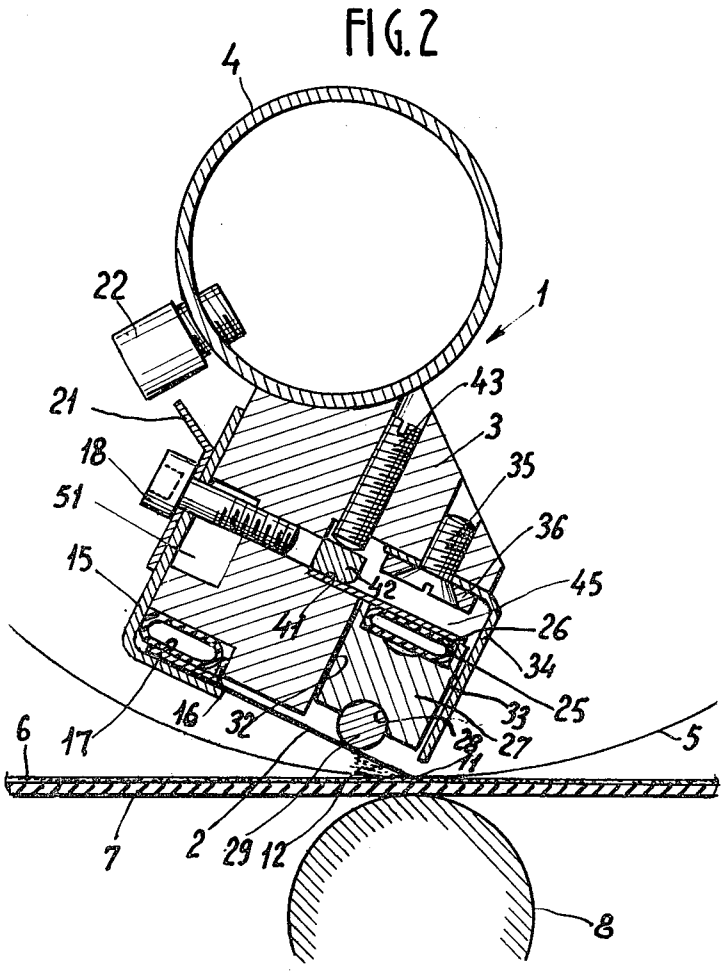

A clearer understanding of the invention will be gained from the description which now follows, reference being had to the accompanying drawings in which one embodiment of a doctor-blade system for screen-printing machines in accordance with the invention is shown by way of example without any limitation being implied, and wherein:

FIG. 1 is a diagrammatic front view of the doctor-blade system as a whole, said system being connected to pipes for supplying cleaning fluid under pressure; and FIGS. 2 and 3 are transverse sectional views to a larger scale taken along lines II-II and III—III respectively of FIG. 1.

The doctor-blade system which is illustrated in FIG. 1 essentially comprises a blade-holder generally designated by the reference 1 and a doctor-blade 2 (as also shown in FIGS. 2 and 3). The blade-holder 1 is constituted by a body 3 attached to a tube 4 which also serves as a color-supply unit and passes within the interior of a rotary screen 5 which is in contact with a web 6 of material to be printed and consisting of either fabric or paper, said web being displaced by a belt 7 which passes over carrier rollers such as the roller 8.

The free edge 11 of the blade 2 distributes ink 12 over the internal surface of the rotary screen 5; the ink passes through said screen and is deposited on the fabric or paper 6 to be printed.

The blade-holder unit 1 which is endowed with the maximum degree of strength and rigidity is supported only by the two extremities of the tube 4 externally of the screen.

The doctor-blade 2 is secured by means of its marginal portion remote from its free edge 11 against one flange of an L-section member 15 by means of a removable packing-strip 16 subjected to the action of a pneumatic locking bladder 17 which is applied against the blade-holder body 3. The other flange of the L-section member 15 is secured to the body 3 by means of screws 18. There is also secured beneath the heads of said screws a member 21 forming an ink weir and extending over the entire length of the blade-holder body 3 beneath the outlet nozzles 22 for the delivery of the color which is supplied through at least one of the two extremities of the tube 4.

The marginal portion of the doctor-blade 2 which is adjacent to the free edge 11 of this latter is subjected to the action of resilient means for applying pressure against the screen 5; said resilient means are essentially constituted by a pneumatic bladder 25 which bears against a stationary flexible strip 26 and thrusts back a longitudinal shoe 27, a semi-circular groove 28 being formed in that face of said shoe which is directed towards the doctor-blade. A rod 29 formed of stainless steel, for example, and preferably made up of several sections is engaged in said groove 28 and applied against the internal face of the doctor-blade 2. The shoe 27 is capable of sliding with a certain play between a longitudinal face 32 of the doctor-blade body 3 and the internal face 33 of one flange of an L-section member 34, the other flange of which is secured to the blade-holder 3 by means of screws 35, a packing-piece 36 being clamped beneath each screwhead.

The flexible bearing strip 26 is secured by means of one of its marginal portions against a bearing face 41 of the blade-holder body 3 by means of a longitudinal packing-strip 42 which is held down by screws 43 mounted within the body 3. That portion of the flexible bearing strip 26 which is not held in position beneath the packing-strip 42 is capable of elastic deformation within a free space 45 formed within the body 3.

In order to clean the entire system from the interior towards the exterior by means of a fluid under pressure, provision is made within the blade-holder body 3 over the entire length of this latter for a front longitudinal passageway 51 and for a rear longitudinal passageway constituted by the aforementioned free space 45 formed within the body 3. The front longitudinal passageway 51 communicates at intervals with the internal face of the doctor-blade 2 by means of ducts 53, 54, the openings of said ducts being located on the doctor-blade at the level of the marginal portion of this latter which is clamped against its supporting member 15. The rear longitudinal passageway 45 also communicates with the internal face of the doctor-blade 2 by means of orifices 57 formed in the flexible bearing strip 26 opposite to the sliding face 32 of the shoe 27 and by means of the gap which exists between said face 32 and the adjacent face of the sliding shoe 27. The rear longitudinal passageway 45 also communicates with the internal face of the doctor-blade 2 through the gap formed between the internal face 33 of the L-section member 34 which serves to guide the shoe 27 and the adjacent face of said shoe. Furthermore, the duct 53 which is in communication with the front passageway 51 also has an opening against that face of the shoe 27 which is intended to slide against the face 32 of the blade-holder body. The two longitudinal cleaning passageways 51 and 45 are closed at both ends of the blade-holder body 3; the front passageway 51 is fitted at one end with a quick union 61 and the rear passageway 45 is connected at the mid-length thereof to another quick union 62 in order to connect said passageways to pipes 71, 72 for the supply of cleaning fluids under pressure. Moreover, the tube 4 which is also closed at both ends is fitted at one end with a quick union 63 for coupling with a pipe 73 which is connected to a source of cleaning fluid under pressure.

The description which now follows will not be concerned with the detailed mechanical operation of the doctor-blade unit which is known per se, but only with the manner in which the whole doctor-blade system is cleaned by virtue of the particular design concept which has been applied to the system in accordance with the invention.

Water is passed into the feed tube 4 through the union 63 which is connected to the pressurized-water pipe 73 so that the entire system can be washed externally in the usual manner by means of a gun for spraying water under pressure. At the same time, washing of the system is carried out from the interior by connecting the two unions 61 and 62 to the pipes 71, 72; said pipes are connected to a source of water under pressure to which a cleaning product may be added if necessary or preferably to a source consisting of a mixture of water and compressed air, the effect of such a mixture being to produce a turbulent flow which is conducive to a highly efficient cleaning action. The pressurized water which is supplied through the front longitudinal passageway 51 passes through the ducts 53, 54 and ensures complete washing of the internal face of the doctor-blade 2. Part of the liquid also passes between the sliding shoe 27 and the blade-holder body 3. The pressurized liquid which is admitted into the rear longitudinal passageway 45, first through the union 62 and then through the duct 64 formed in the blade-holder body 3, passes partly through the orifices 57 of the flexible bearing strip 26 and within the gap between the sliding shoe 27 and the body face 32 and partly between said shoe and the face 33 of the shoe-guiding member 34; said liquid finally reaches the internal face of the doctor-blade 2 and escapes downwards from this latter.

Perfect cleaning is thus obtained since any trace of color is discharged from the interior to the exterior.

On completion of this washing operation, compressed air can be passed into the ducts of the system in order to remove any trace of water and may be preheated if necessary in order to achieve enhanced drying. Drying of the exterior is also completed with air, preference being again given to the use of hot air for this purpose.

It is readily apparent that the invention is not limited to the embodiment described and illustrated but permits many alternative forms within the reach of anyone versed in the art according to the applications which may be contemplated, without thereby departing either from the scope or the spirit of the invention.

I claim:

1. An apparatus for use with a printing machine having a screen, said apparatus comprising:

an elongated doctor-holder including a body and a color supply unit secured to said body for supply of colorant onto the outer surface of said body, a doctor including an elongated strip of thin flexible material having an inner face, an outer face, a longitudinal free wiping marginal portion to be operably engaged at said outer face against the screen of said printing machine and an opposite longitudinal marginal securing portion, said colorant flowing on said outer surface of the body to the space between the outer face of the doctor and the screen, holding means on said doctor-holder for firmly holding said marginal securing portion of said doctor, resilient means in said doctor-holder for applying pressure on said longitudinal free wiping marginal portion of said doctor to urge the same against the printing screen during a printing process, said body having a longitudinal conduit communicating with said inner face of said doctor and with said resilient means, and union means carried by said doctor-holder and communicating with said longitudinal conduit for connection to a source of cleaning pressure fluid to supply such cleaning pressure fluid to said inner face of the doctor and said resilient means via said conduit to clean accumulated colorant thereat.

2. Apparatus as claimed in claim 1, wherein said doctor-holder is provided with ducts extending transversely with respect to said longitudinal conduit for establishing communication between said longitudinal conduit and said inner face of said doctor in the immediate vicinity of said marginal securing portion of said doctor.

3. Apparatus as claimed in claim 1, wherein said resilient means has a first face turned toward said inner face of said doctor and a second face remote from said first face, said longitudinal conduit being in communication with said second face of said resilient means.

4. Apparatus as claimed in claim 1 wherein said longitudinal conduit portion comprises a first conduit communicating with said inner face of said doctor and a second conduit portion communicating with said resilient means.

5. Apparatus as claimed in claim 1, wherein said resilient means comprises a pneumatic pressure bladder and a flexible bearing strip having two adjacent longitudinal portions, one of said longitudinal portions having a first face engaged against said pneumatic pressure bladder and the other of said adjacent longitudinal portions being secured to said doctor-holder, said longitudinal conduit communicating with the face of said flexible bearing strip opposite said first face of said strip, said flexible bearing strip being provided with apertures along a line extending between said two longitudinal portions of said flexible bearing strip.

6. Apparatus as claimed in claim 5 comprising a movable shoe interposed between said inner face of said doctor and said pneumatic pressure bladder, said movable shoe having two lateral faces in sliding engagement with said doctor-holder, said apertures of said flexible bearing strip being in registry with one of said lateral faces of said shoe.

* * * * *